US008576109B2

(12) United States Patent
Stark et al.

(10) Patent No.: US 8,576,109 B2
(45) Date of Patent: Nov. 5, 2013

(54) METHOD AND CONFIGURATION FOR GENERATING HIGH-ENERGY MICROWAVE PULSES

(75) Inventors: Robert Stark, Bad Windsheim (DE); Tilo Ehlen, Muenster (DE)

(73) Assignee: Diehl BGT Defence GmbH & Co. KG, Ueberlingen (DE)

( * ) Notice: Subject to any disclaimer, the term of this patent is extended or adjusted under 35 U.S.C. 154(b) by 202 days.

(21) Appl. No.: 13/155,424

(22) Filed: Jun. 8, 2011

(65) Prior Publication Data

US 2011/0309870 A1 Dec. 22, 2011

(30) Foreign Application Priority Data

Jun. 17, 2010 (DE) ..... 10 2010 024 214

(51) Int. Cl.
*H04K 3/00* (2006.01)

(52) U.S. Cl.
USPC ..... 342/14; 342/13; 327/181; 307/106

(58) Field of Classification Search
USPC ..... 327/181; 342/13, 14; 307/106
See application file for complete search history.

(56) References Cited

U.S. PATENT DOCUMENTS

| | | | | |
|---|---|---|---|---|
| 3,748,528 | A | 7/1973 | Cronson | |
| 5,489,818 | A * | 2/1996 | Naff et al. | 315/39 |
| 7,233,084 | B2 | 6/2007 | Dommer et al. | |
| 7,629,918 | B2 * | 12/2009 | Brown et al. | 342/13 |
| 7,775,146 | B1 * | 8/2010 | Bitar et al. | 89/1.13 |
| 2008/0174469 | A1 * | 7/2008 | Stark et al. | 342/14 |

FOREIGN PATENT DOCUMENTS

| | | | |
|---|---|---|---|
| DE | 103 13 286 | B3 | 1/2005 |
| DE | 10 2006 014 230 | A1 | 10/2007 |
| WO | 2007/112850 | A1 | 10/2007 |

* cited by examiner

*Primary Examiner* — Patrick O'Neill
(74) *Attorney, Agent, or Firm* — Laurence A. Greenberg; Werner H. Stemer; Ralph E. Locher

(57) ABSTRACT

A method and a configuration are provided for generating high-energy microwave pulses, in particular based on HPEM technology. The objects include, on the one hand. increasing the energy density of pulses and, on the other hand, also making the relevant appliances more compact. For that purpose, a large-area configuration of a multiplicity of, preferably non-linear, semiconductor components is used in the area of the antenna, for pulse shaping.

21 Claims, 3 Drawing Sheets

METHOD AND CONFIGURATION FOR GENERATING HIGH-ENERGY MICROWAVE PULSES

CROSS-REFERENCE TO RELATED APPLICATION

This application claims the priority, under 35 U.S.C. §119, of German patent application DE 10 2010 024 214.4, filed Jun. 17, 2010; the prior application is herewith incorporated by reference in its entirety.

BACKGROUND OF THE INVENTION

Field of the Invention

The present invention relates to a method for the generation of high-energy microwave pulses, in particular those based on HPEM technology, wherein a pulse, preferably a so-called DS pulse, is generated by way of a pulse generator that is fed from an energy source. The DS pulse is then emitted via an antenna. The present invention also relates to a corresponding configuration for generating high-energy microwave pulses.

High-energy or high-energy-density microwave pulses, in particular those based on HPEM (high power electromagnetic) technology, are used nowadays to destroy electronic components in objects which represent a threat, for example those of explosive charges that are fired on a time basis or are controlled by mobile telephones, for example explosive traps or the like, or at least to render them inoperable. Corresponding systems that generate such microwave pulses are preferably used in the form of portable systems or are carried on vehicles. They should therefore be as compact as possible. However, the capability to use such systems is not only restricted to the short-range domain, but can also be extended over longer ranges, for example with the aim of adversely affecting the flight path of electronically controlled objects, such as rockets or the like. The object for these described operational capabilities is to produce pulses with an energy density and a power that is as high as possible.

U.S. Pat. No. 3,748,528 describes a microwave pulse generator in which a pulse with a flank gradient in the order of magnitude of one nanosecond and an amplitude in the range from 12-20 kV is produced on a first radio path. That pulse is then converted via a further, series-connected radio path, which acts as a switch, to a damped sinusoidal oscillation (DS pulse) and is emitted via a reflector and an antenna. With systems such as those, the flank gradient of the emitted pulse is generally limited.

In order to increase the energy density of pulses such as these, the art has additionally moved towards providing configurations with a plurality of parallel-connected microwave generators, as described in the commonly assigned German published patent application DE 10 2006 014 230 A1 and German patent DE 103 13 286 B3 (corresp. to U.S. Pat. No. 7,233,084 B2). However, configurations such as those have the disadvantage that they require a certain amount of space, and are therefore suitable only to limited extent for systems with reduced dimensions.

SUMMARY OF THE INVENTION

It is accordingly an object of the invention to provide a method and a configuration for generating high-energy microwave pulses which overcome the above-mentioned disadvantages of the heretofore-known devices and methods of this general type and which, on the one hand, allow the microwave pulse to be emitted to have a high energy density, as well as being of simple design and with the dimensions being smaller than those of prior art configurations, while on the other hand allowing increased flexibility in the area of pulse shaping.

With the foregoing and other objects in view there is provided, in accordance with the invention, a method for generating high-energy microwave pulses, preferably HPEM technology-based pulses, the method which comprises:

generating a pulse by way of a pulse generator supplied from an energy source;

providing a flat configuration with a multiplicity of conductor components distributed over a given area at an antenna;

subjecting the flat configuration in the area of the antenna to an electromagnetic field of the pulse produced by the pulse generator; and producing a resultant pulse in the conductor components as a result of an influence of the pulse on the configuration of the conductor components, and emitting the resultant pulse via the antenna.

In a preferred embodiment, the pulse generated with the pulse generator is a damped sinusoidal oscillation pulse.

The concept of the present invention is to provide a large-area, array-like configuration in the area of the antenna, consisting of a multiplicity of conductor components which are distributed over an area and are preferably connected in parallel and/or in series with one another. The pulse originating from the pulse generator produces or induces a surface current in the flat configuration of the conductor components, which surface current itself generates the field to be emitted. The idea offers the advantage of allowing specific measures relating to the shaping of the pulse to be emitted to be implemented by means of the conductor components. For example, an effective increase in the flank gradient of the resultant pulse produced by the large-area configuration can be achieved by using non-linear conductor components, that is to say conductor components with a non-linear characteristic. A pulse such as this has a very high energy density. On the other hand, each conductor component is loaded to a lesser extent by the arriving pulse, in inverse proportion to the total number of conductor components. This in turn results in the advantage that conductor components, in particular semiconductor components as well, can be used as conductor components which, when considered in their own right, would be subject to physical limits and could therefore not be used.

Since the conductor components are arranged in a cascade, a directed series circuit (cascading) is achieved, as a result of which the physical effects of the individual conductor components are added overall, even though they are each loaded only in the proportional fraction by the corresponding pulse. The total energy flow is subdivided and need not be passed via a single conductor component.

The cascading may be in series, parallel or preferably in parallel and series. The resultant energy flow from the arriving pulse is in the latter case distributed optimally.

The non-linearity, that is to say the presence of a non-linear characteristic, may be a property of the individual conductor components.

However, alternatively or additionally, the cascade of the conductor components may also have non-linearity overall.

The invention makes it possible to also use active conductor components, in addition to passive conductor components, that is to say conductor components which cannot be controlled. If the conductor components are active components, the pulse can be deliberately controlled and thus deliberately shaped in the area of the antenna. In particular, additional patterns can be modulated onto the pulse. Modulation onto the pulse can be an important additional criterion in particular for controlling directional pulses (beam steering).

It is also possible to provide a part of the large-area configuration of the multiplicity of conductor components with active conductor components, and a further part with passive conductor components. This results in wide degrees of freedom for influencing, that is to say monitoring and controlling, the pulse characteristic.

Active influencing can be carried out in particular by application of a voltage to the conductor components, or by varying the applied voltage or the current level.

With regard to the configuration for generation of high-energy microwave pulses, which is also claimed in an independent claim, it is particularly appropriate to use a reflector antenna, for example a so-called IRA antenna (impulse radiating antenna), since the conductor components can be fitted well on the large-area reflector of the antenna.

However, the invention is not restricted to this. A so-called horn antenna is also suitable, since the flat configuration of the conductor components may in this case be located on the wall which closes the widening horn. The pulse passes through this as it emerges. Other flat antennas may also be used.

In particular, semiconductor components such as diodes are suitable for provision of non-linear conductor components. When a pulse is applied, a diode allows the flank gradient of the emerging pulse to be increased in comparison to the pulse arriving in the diode.

Instead of a diode, an inductance, in particular a non-linear inductance, may also be used as a conductor component.

It is particularly advantageous to use individual conductive patch arrays, which in total form the antenna and generate the pulse (patch antenna). The patch arrays are isolated from one another, in order to achieve a suitable current flow through the individual conductor components.

Alternatively, the patch arrays may also be decoupled from one another or connected to one another, for example resistively or inductively. This allows increased flexibility in the area of pulse shaping and configuration of the reflector.

Other features which are considered as characteristic for the invention are set forth in the appended claims.

Although the invention is illustrated and described herein as embodied in a method and configuration for generation of high-energy microwave pulses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
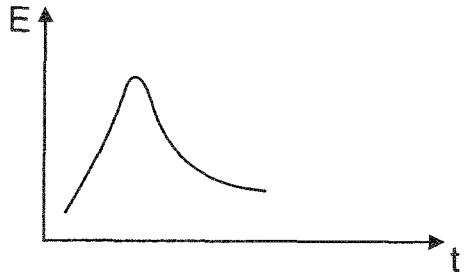
FIG. 1 is a graph showing a simplified illustration of the pulse shape of a pulse produced directly by a pulse generator.
Figure 2:
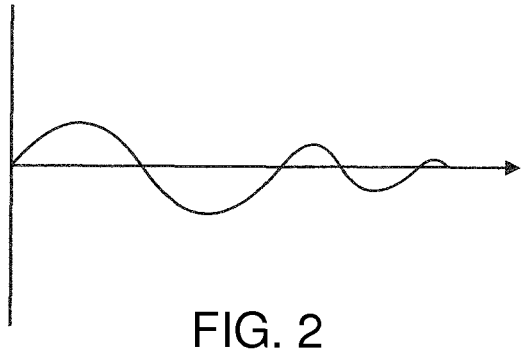
FIG. 2 is a graph showing a simplified illustration of the pulse shape after conversion of the pulse shown in FIG. 1 to a DS pulse.
Figure 3:
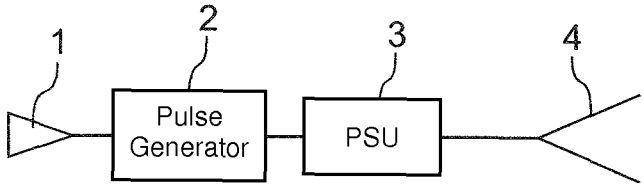
FIG. 3 shows a highly simplified schematic illustration of a configuration for generating and emitting a microwave pulse.

Referring now to the figures of the drawing in detail and first, particularly, to FIG. 3 thereof, there is shown a highly simplified configuration or assembly for generating a high-energy microwave pulse, for example, a DS (damped sinusoid) pulse. The assembly comprises an energy source 1, for example a battery with a very high voltage. The energy source 1 feeds a pulse generator 2, for example a so-called Marx generator, which produces a voltage pulse in the order of magnitude from, for example, 0.3 to 3.0 MV and with the shape shown in FIG. 1. The above-mentioned pulse is converted by a suitable pulse-shaping unit (PGU) 3 to a damped sinusoidal oscillation (DS), as is illustrated in FIG. 2, for example. The DS pulse is then emitted to the surrounding area via the antenna 4.

Figure 4:
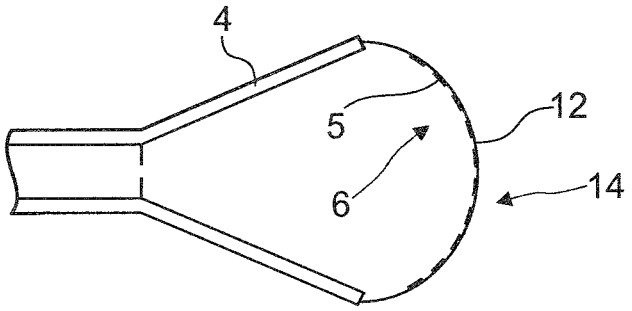
FIG. 4 is a highly simplified schematic illustration of the area of the antenna of a first refinement of the flat configuration of conductor components according to the invention.

According to the invention, of FIG. 4, a large-area configuration 6, 15 of conductor components 5, in particular semiconductor components, is provided, preferably in the area of the antenna 4. The conductor components 5 are cascaded both in parallel and in series. The configuration 6, 15 is subjected directly to the electrical and magnetic field of the pulse from the pulse generator 2 or the DS pulse from the pulse-shaping unit 3. As a result of this, the entire energy flow is passed via the flat configuration 6, 15 of the individual conductor components 5, and not only via a single element. The field of the arriving pulse produces a surface current, which itself in turn generates the field of the resultant pulse to be emitted.

An increase in the flank gradient, or edge steepness, of the pulse to be emitted, in comparison to the arriving pulse, is achieved by way of a non-linear characteristic. Conductor components 5 with a non-linear characteristic are preferably used for this purpose.

Figure 6A:
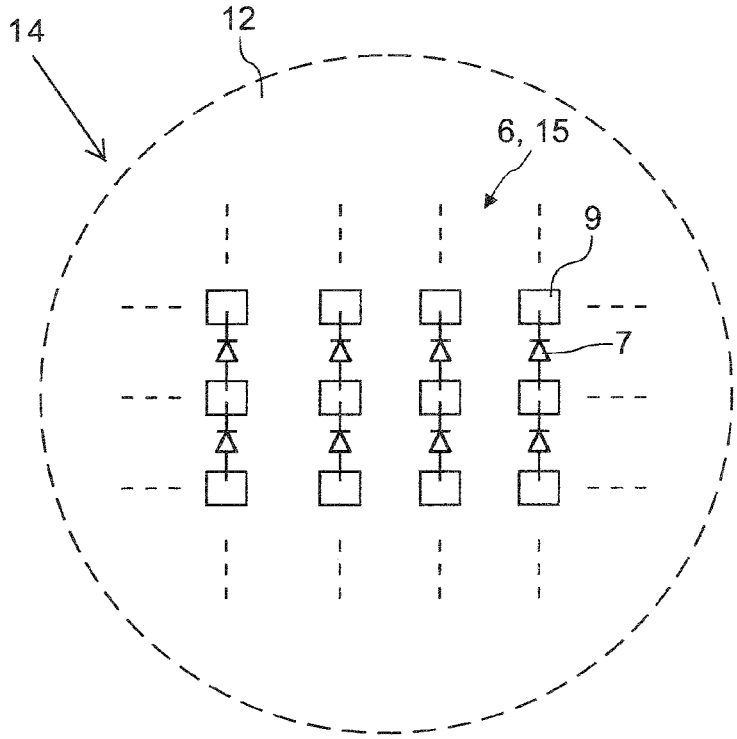
FIG. 6A is a highly simplified schematic illustration of part of the flat configuration of diodes as non-linear conductor components in the area of the reflector in the embodiment of FIG. 4, or in the area of the wall of the embodiment as shown in FIGS. 5A and 5B.
Figure 6B:
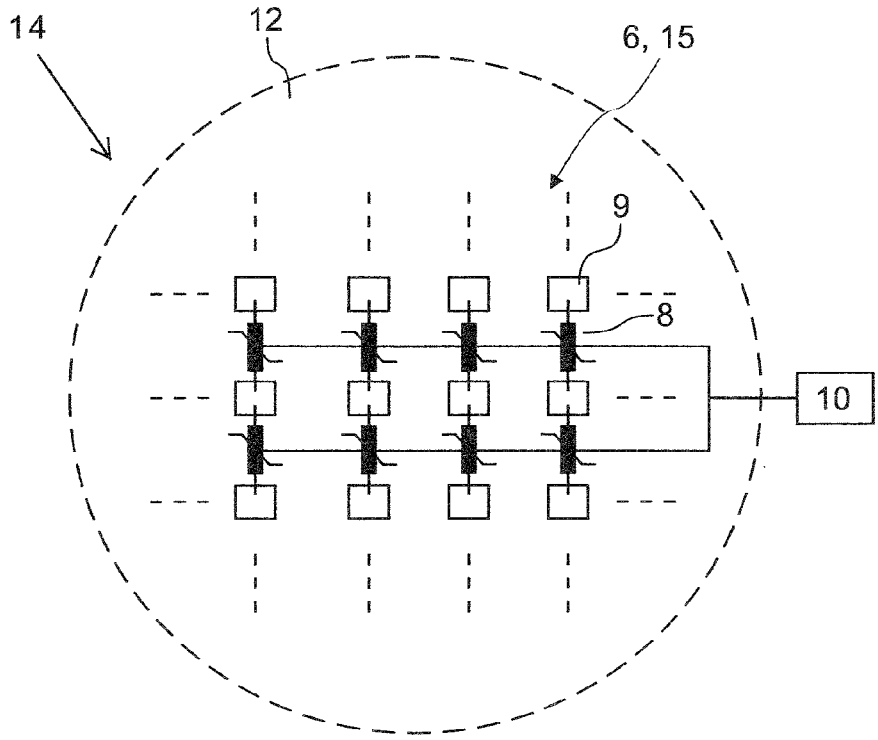
FIG. 6B is a highly simplified schematic illustration of a part of the flat configuration of inductances as non-linear conductor components in the area of the reflector in the embodiment of FIG. 4 or in the area of the wall of the embodiment as shown in FIGS. 5A and 5B.

As is shown in FIG. 6, the non-linear conductor components 5 may be diodes 7 (cf. FIG. 6A) or inductances 8 (FIG. 6B). As can be seen from FIGS. 6A and 6B, a multiplicity of individual patch arrays 9, which are isolated from one another are provided on a reflector mount 12. The individual patch arrays 9 are connected to one another in the direction of the cascade via the non-linear conductor components, in particular the diodes 7 or inductances 8.

Alternatively, the patch arrays can also be decoupled from one another or connected to one another, for example resistively or inductively. This allows more flexibility in the context of pulse shaping and configuration of the reflector.

Figure 5A:
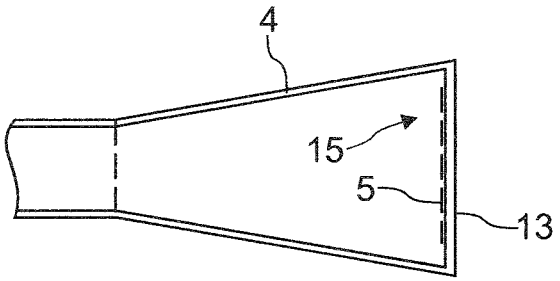
FIG. 5A is a highly simplified schematic illustration of the area of the antenna of a second refinement of the flat configuration of conductor components according to the invention.

The flat configuration 6 is expediently located in the area of the reflector 14 of an IRA antenna as is illustrated in FIG. 4. The flat configuration 6 of the individually distributed conductor components 5 results overall in a non-linear reflection characteristic, which leads to an effective increase in the flank gradient of the pulse to be emitted from the reflector 14, and therefore to a higher energy density. Alternatively, the flat configuration 15 may also be a component of a wall 13 of a horn antenna as is illustrated in FIG. 5A. In this case, the pulse is shaped, while it passes through the wall 13 including the flat configuration 15 of non-linear conductor components 5 arranged on it. The flat configuration 15 of non-linear conductor components 5 is arranged on a plane at right angles to the longitudinal axis, in the refinement shown in FIG. 5A. However, a different orientation may also be provided, for example obliquely with respect to the longitudinal axis or the like.

Figure 5B:
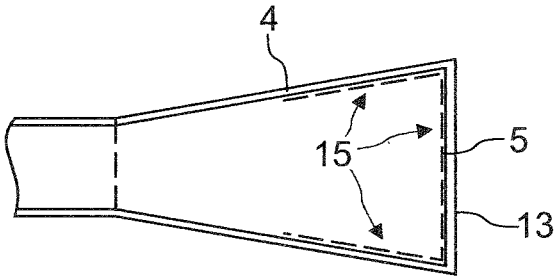
FIG. 5B is a highly simplified schematic illustration of the area of the antenna of a third refinement of the flat configuration of conductor components according to the invention.

As is illustrated in FIG. 5B it is, for example, possible to provide a flat configuration of conductor components which comprises subareas arranged at an angle to one another. In a corresponding manner, some of the conductor components 5 run along the wall 13, and the others along the diverging part of the antenna.

Furthermore, for active monitoring and control of the pulse characteristic, it is possible to actively control the conductor components 5 overall or else only in areas, in order in this way to deliberately influence the formation of the pulse. For example, conductor components 5 along the wall 13 can be operated passively, that is to say not operated, while those along the diverging part of the antenna 4 are operated actively, that is to say they are controlled.

As already mentioned, the conductor components may be passive or else active conductor components. In the case of active conductor components, the shape of the pulse to be emitted can additionally be influenced by means of a control device 10 (as is indicated in FIG. 6B) by application of a suitable voltage or current. In particular, the pulse can be modulated, which may be advantageous for so-called beam steering.

Overall, the present invention renders it possible to produce pulses with an increased energy density without any loss of compactness of the relevant devices. Furthermore, the invention allows active monitoring and control of the pulse characteristic by means of the reflector. The present invention therefore represents a very particular contribution to the relevant field of technology.

The invention claimed is:

1. A method for generating high-energy microwave pulses, the method which comprises:

generating a pulse by way of a pulse generator supplied from an energy source;

providing a flat configuration with a multiplicity of conductor components distributed over a given area at an antenna;

subjecting the flat configuration in the area of the antenna to an electromagnetic field of the pulse produced by the pulse generator; and producing a resultant pulse in the conductor components as a result of an influence of the pulse on the configuration of the conductor components, and emitting the resultant pulse via the antenna.

2. The method according to claim 1, which comprises generating high-energy microwave pulses in high power electromagnetic (HPEM) technology and generating with the pulse generator a damped sinusoidal oscillation (DS) pulse.

3. The method according to claim 1, which comprises generating the resultant pulse with a flank gradient that is greater than a flank gradient of an incoming pulse because of an influence of the pulse on the configuration of the conductor components.

4. The method according to claim 1, wherein the conductor components are arranged in a cascade.

5. The method according to claim 1, wherein the configuration of the conductor components forms a non-linear conductor overall and/or the conductor components are individual non-linear components.

6. The method according to claim 1, wherein the conductor components are active, controllable conductor components, and the method further comprises actively influencing a shape of the emitted pulse by appropriate control.

7. The method according to claim 6, which comprises varying an electrical bias voltage of the active, controllable conductor components for control purposes.

8. A configuration for generating high-energy microwave pulses, the configuration comprising:

an energy source;

a pulse generator connected to said energy source and configured to generate a pulse;

an antenna connected to said pulse generator for emitting the pulse; and a large-area configuration with a multiplicity of conductor components disposed at said antenna.

9. The configuration according to claim 8, wherein said conductor components of said large-area configuration are semiconductor components.

10. The configuration according to claim 8, wherein said pulse generator is configured to generate a damped sinusoidal oscillation pulse.

11. The configuration according to claim 8 configured to emit high-energy microwave pulses based on HPEM technology.

12. The configuration according to claim 8, wherein said antenna is a reflector antenna with a reflector and said configuration with said conductor components is disposed on said reflector.

13. The configuration according to claim 12, wherein:

said reflector is divided into individual patch arrays;

said individual patch arrays are isolated from one another or are electrically decoupled from one another; and said conductor components bridge said individual patch arrays.

14. The configuration according to claim 8, wherein said antenna is a horn antenna, and said configuration with said conductor components is disposed on a wall through which the pulse passes and which is oriented at right angles to a longitudinal axis of the horn.

15. The configuration according to claim 8, wherein said conductor components are configured to establish a non-linear characteristic overall.

16. The configuration according to claim 8, wherein said conductor components are non-linear conductor components.

17. The configuration according to claim 8, wherein said conductor components are active conductor components.

18. The configuration according to claim 8, wherein said large-area configuration with said multiplicity of conductor components comprises active and passive conductor components.

19. The configuration according to claim 8, wherein said conductor components are diodes or inductances.

20. The configuration according to claim 8, wherein said antenna is a patch antenna.

21. The configuration according to claim 8, which further comprises a control device for controlling the individual said conductor components for modulation of the pulse to be produced.

* * * * *